US011724149B2

(12) United States Patent
Antunez et al.

(10) Patent No.: US 11,724,149 B2
(45) Date of Patent: Aug. 15, 2023

(54) TIRE EXERCISE SYSTEM

(71) Applicants: Vincent Matthew Antunez, Schertz, TX (US); John T. Sharp, Selma, TX (US)

(72) Inventors: Vincent Matthew Antunez, Schertz, TX (US); John T. Sharp, Selma, TX (US)

( * ) Notice: Subject to any disclaimer, the term of this patent is extended or adjusted under 35 U.S.C. 154(b) by 108 days.

(21) Appl. No.: 17/088,084

(22) Filed: Nov. 3, 2020

(65) Prior Publication Data

US 2021/0046350 A1 Feb. 18, 2021

Related U.S. Application Data

(60) Division of application No. 16/370,798, filed on Mar. 29, 2019, now Pat. No. 10,857,410, which is a (Continued)

(51) Int. Cl.
*A63B 21/00* (2006.01)
*A63B 21/065* (2006.01)
(Continued)

(52) U.S. Cl.
CPC ..... *A63B 21/0601* (2013.01); *A63B 21/0004* (2013.01); *A63B 21/065* (2013.01);
(Continued)

(58) Field of Classification Search
CPC . A63B 21/0601; A63B 21/16; A63B 23/0355; A63B 21/4043; A63B 21/4009; A63B 21/0004; A63B 21/065; A63B 21/4005; A63B 21/0442; A63B 21/0552; A63B 2209/10; A63B 2209/00; A63B 2207/02; A63B 21/4035; A63B 23/047; A63B 21/151; A63B 2225/687; A63B 21/06–0601; A41F 9/025
See application file for complete search history.

(56) References Cited

U.S. PATENT DOCUMENTS 6,202,263 B1 * 3/2001 Harker ..... B62J 7/08 2/237
6,500,102 B1 12/2002 Domenge
6,702,686 B1 3/2004 Brown
6,868,586 B1 3/2005 Hall
(Continued)

FOREIGN PATENT DOCUMENTS

WO WO-2014172771 A1 * 10/2014 ..... A47D 13/086

*Primary Examiner* — Andrew S Lo
(74) *Attorney, Agent, or Firm* — Loza & Loza, LLP; Kevin L. Soules

(57) ABSTRACT

A tire exercise system has a tire having an interior portion covered with an inner tire cover. At least four shoulder strap attachment points are attached to the tire and configured to secure a right and left shoulder strap. At least two handles are attached to the tire and configured to accommodate human hands. At least two anchors are attached to the tire and configured to accommodate a rope system. A waist harness includes a waist belt. An anchor is attached to the waist belt. A rope system is attached to the tire and the waist harness. The rope system includes a first carabiner attached to a bungee cord, which can then be attached to the tire. A ring is attached to the bungee cord. A rope is attached to the ring. A second carabiner is attached to the rope, which can then be attached to the waist harness.

11 Claims, 8 Drawing Sheets

Related U.S. Application Data continuation-in-part of application No. 15/704,659, filed on Sep. 14, 2017, now Pat. No. 10,300,323.

(51) Int. Cl.

| | |
|---|---|
| ***A63B 21/16*** | (2006.01) |
| ***A63B 21/04*** | (2006.01) |
| ***A63B 21/055*** | (2006.01) |
| ***A63B 21/06*** | (2006.01) |
| ***A63B 23/04*** | (2006.01) |
| ***A63B 23/035*** | (2006.01) |

(52) U.S. Cl.

CPC ..... *A63B 21/151* (2013.01); *A63B 21/16* (2013.01); *A63B 21/4005* (2015.10); *A63B 21/4009* (2015.10); *A63B 21/4035* (2015.10); *A63B 21/4043* (2015.10); *A63B 23/0355* (2013.01); *A63B 23/047* (2013.01); *A63B 21/0442* (2013.01); *A63B 21/0552* (2013.01); *A63B 2209/00* (2013.01); *A63B 2209/10* (2013.01); *A63B 2225/687* (2013.01); *A63B 2225/74* (2020.08)

(56) References Cited

U.S. PATENT DOCUMENTS

| | | | | |
|---|---|---|---|---|
| D514,392 | S | 2/2006 | Bruns | |
| 7,025,644 | B2 * | 4/2006 | Geier | B63H 19/02 441/74 |
| D588,975 | S | 3/2009 | Spater et al. | |
| D751,655 | S | 3/2016 | Januszek | |
| D800,233 | S | 10/2017 | Januszek | |
| 2005/0059533 | A1 | 3/2005 | Hobbs | |
| 2005/0187075 | A1 | 8/2005 | Bellamy | |
| 2005/0217748 | A1 * | 10/2005 | Ikegami | D04C 1/12 139/388 |
| 2005/0239027 | A1 * | 10/2005 | Streeter | A63B 69/0064 434/253 |
| 2005/0251895 | A1 * | 11/2005 | Farrah | A63B 69/0064 441/80 |
| 2009/0105001 | A1 | 4/2009 | Burgaard et al. | |
| 2009/0275450 | A1 | 11/2009 | Best | |
| 2012/0083348 | A1 | 4/2012 | Burgaard et al. | |
| 2013/0172160 | A1 | 7/2013 | Poole | |
| 2015/0105169 | A1 | 4/2015 | Fens | |
| 2015/0165258 | A1 | 6/2015 | Januszek | |
| 2017/0065897 | A1 | 3/2017 | Cordray et al. | |
| 2017/0296861 | A1 | 10/2017 | Burkinshaw | |
| 2018/0015318 | A1 | 1/2018 | Nelson | |

* cited by examiner

TIRE EXERCISE SYSTEM

CROSS REFERENCE TO RELATED PATENT APPLICATIONS

This patent application is a divisional of U.S. patent application Ser. No. 16/370,798, titled, "TIRE EXERCISE SYSTEM" which was filed on Mar. 29, 2019. U.S. patent application Ser. No. 16/370,798 is herein incorporated by reference in its entirety.

U.S. patent application Ser. No. 16/370,798 is a continuation in part of nonprovisional patent application Ser. No. 15/704,659, entitled "TIRE EXERCISE SYSTEM," filed Sep. 14, 2017. U.S. patent application Ser. No. 15/704,659 is herein incorporated by reference in its entirety.

This patent, U.S. patent application Ser. No. 16/270,798, and U.S. patent application Ser. No. 15/704,659 claim the priority and benefit under 35 U.S.C. § 119(e) of U.S. Provisional Patent Application Ser. No. 62/362,514, filed Jul. 14, 2016, entitled "TIRE EXERCISE SYSTEM." U.S. Provisional Patent Application Ser. No. 62/362,514 is herein incorporated by reference in its entirety.

TECHNICAL FIELD

The present embodiments are generally related to exercise equipment. The embodiments are related to methods and systems for exercising using tire-based devices. The embodiments are additionally related to methods and systems for a harness system associated with a tire and used for exercise.

BACKGROUND

Exercise and exercise related equipment are increasingly popular in the fitness industry, which has continued to expand beyond traditional exercise activities. Many people have adopted new methods of exercising, and many of these methods involve the use of new or alternative fitness equipment.

Prior to the development of the embodiments disclosed herein, there were no good systems or apparatuses for individuals that desired to train with a tire pull, or that wanted to use a tire for a full body workout. In addition, prior art methods that include the use of a tire are generally not sufficient to address a number of the challenges associated with exercise equipment. Such methods and systems are generally unsafe, difficult to manage, and not sufficient to provide a variety of different exercises.

Accordingly, there is a need for methods and systems that provide means for incorporating tires into fitness routines.

SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is therefore one aspect of the disclosed embodiments to provide a method and system for improved fitness equipment.

It is another aspect of the disclosed embodiments to provide tire pulling systems and methods.

It is yet another aspect of the disclosed embodiments to provide enhanced fitness equipment making use of tires and additional harnessing and gripping equipment.

The aforementioned aspects and other objectives and advantages can now be achieved as described herein. In embodiments disclosed herein, a system, method, and apparatus for a tire exercise system includes a tire having an interior portion covered with an inner tire cover. At least four shoulder strap attachment points are attached to the tire and configured to secure a right and left shoulder strap. At least two handles are attached to the tire and configured to accommodate human hands. At least two anchors are attached to the tire and configured to accommodate a rope system. A waist harness includes a waist belt. An anchor is attached to the waist belt. A rope system is attached to the tire and the waist harness. The rope system includes a first carabiner attached to a bungee cord, which can then be attached to the tire. A ring is attached to the bungee cord. A rope is attached to the ring. A second carabiner is attached to the rope, which can then be attached to the waist harness.

BRIEF DESCRIPTION OF THE FIGURES

The accompanying figures, in which like reference numerals refer to identical or functionally-similar elements throughout the separate views and which are incorporated in, and form a part of, the specification, further illustrate the embodiments and, together with the detailed description, serve to explain the embodiments disclosed herein.

DETAILED DESCRIPTION

Figure 1:
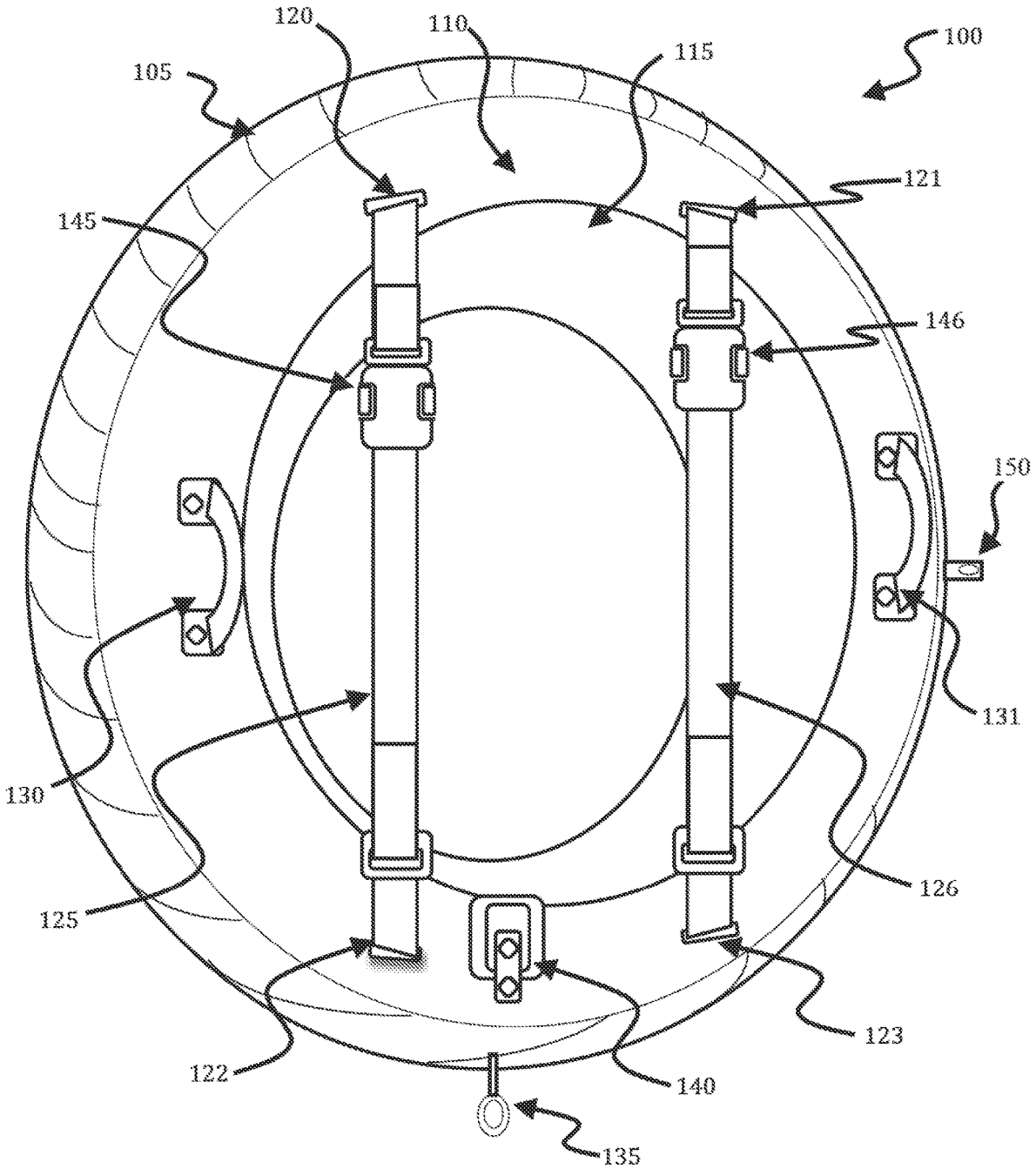
FIG. 1 depicts a tire exercise system in accordance with the disclosed embodiments.

The particular values and configurations discussed in the following non-limiting examples can be varied, and are cited merely to illustrate one or more embodiments and are not intended to limit the scope thereof.

Example embodiments will now be described more fully hereinafter with reference to the accompanying drawings, in which illustrative embodiments are shown. The embodiments disclosed herein can be embodied in many different forms and should not be construed as limited to the embodiments set forth herein; rather, these embodiments are provided so that this disclosure will be thorough and complete, and will fully convey the scope of the embodiments to those skilled in the art. Like numbers refer to like elements throughout.

The terminology used herein is for the purpose of describing particular embodiments only and is not intended to be limiting. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part.

In general, terminology may be understood at least in part from usage in context. For example, terms such as "and," "or," or "and/or" as used herein may include a variety of meanings that may depend at least in part upon the context in which such terms are used. Typically, "or" if used to associate a list, such as A, B, or C, is intended to mean A, B, and C, here used in the inclusive sense, as well as A, B, or C, here used in the exclusive sense. In addition, the term "one or more" as used herein, depending at least in part upon context, may be used to describe any feature, structure, or characteristic in a singular sense or may be used to describe combinations of features, structures, or characteristics in a plural sense. In addition, the term "based on" may be understood as not necessarily intended to convey an exclusive set of factors and may, instead, allow for existence of additional factors not necessarily expressly described, again, depending at least in part on context.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The embodiments disclosed herein provide a tire exercise system that includes a tire having an interior portion covered with an inner tire cover. Shoulder strap attachment points are attached to the tire and configured to secure a right and left shoulder strap. In some embodiments, four or more strap attachment points can be included although other embodiments can include more or fewer such attachment points. The straps are configured such that they can be attached and released from the attachment points and further converted into a shoulder harness pulling system. At least two handles are attached to the tire and configured to accommodate human hands. At least two anchors are attached to the tire and configured to accommodate a rope system. A safety light can be attached to one of the tire anchor points.

A waist harness can be included in the system. The waist harness includes a waist belt. An anchor can be attached to the waist belt. Reflector strips can also be attached to the waist belt.

The system can further include an arrangement of one or more ropes that can be attached to the tire, the waist harness, and/or the convertible shoulder harness. The rope system includes a first carabiner attached to a bungee cord, which can then be attached to the tire. A ring is attached to the bungee cord and one of the one or more ropes is attached to the ring. A second carabiner is similarly attached to the rope, which can then be attached to the waist harness.

FIG. 1 illustrates an embodiment of a tire exercise system 100 in accordance with the disclosed embodiments. The tire exercise system 100 can comprises a tire 105 having an interior portion 110 covered with an inner tire cover 115. Shoulder strap attachment points 120-123 are attached to the tire 105 and configured to secure a right shoulder strap 125 and left shoulder strap 126.

In an exemplary embodiment, the upper surface of the tire 105 can include the two shoulder-carrying straps 125 and 126, attached between the 1:00-2:00 o'clock and 4:00-5:00 o'clock positions on the tire 105 for the left shoulder strap 126, and between the 10:00-11:00 o'clock and 7:00-8:00 o'clock positions on the tire 105 for the right shoulder strap 125. The shoulder straps 125 and 126 allow the tire exercise system 100 to be carried as one would carry a backpack.

The straps 125 and 126 can be held in place by quick release brackets 145 and 146, respectively. The quick release brackets 145 and 146 provide easy donning and doffing of the system 100. In certain embodiments, the straps 125 and 126 can be secured to the tire 105 with machine screws, nuts, and washers after appropriate sized holes have been formed in the tire 105.

The straps 125 and 126 can be fully padded for comfort and include adjustments so that optimal fit for the user is possible. The quick release straps 125 and 126 can be reconfigured to allow the shoulder straps 125 and 126 to convert to a shoulder harness pulling system 200 to allow the user to exercise the upper chest and back in a different manner. The padding and quick release help reduce chaffing and axillary nerve irritation.

Figure 2:
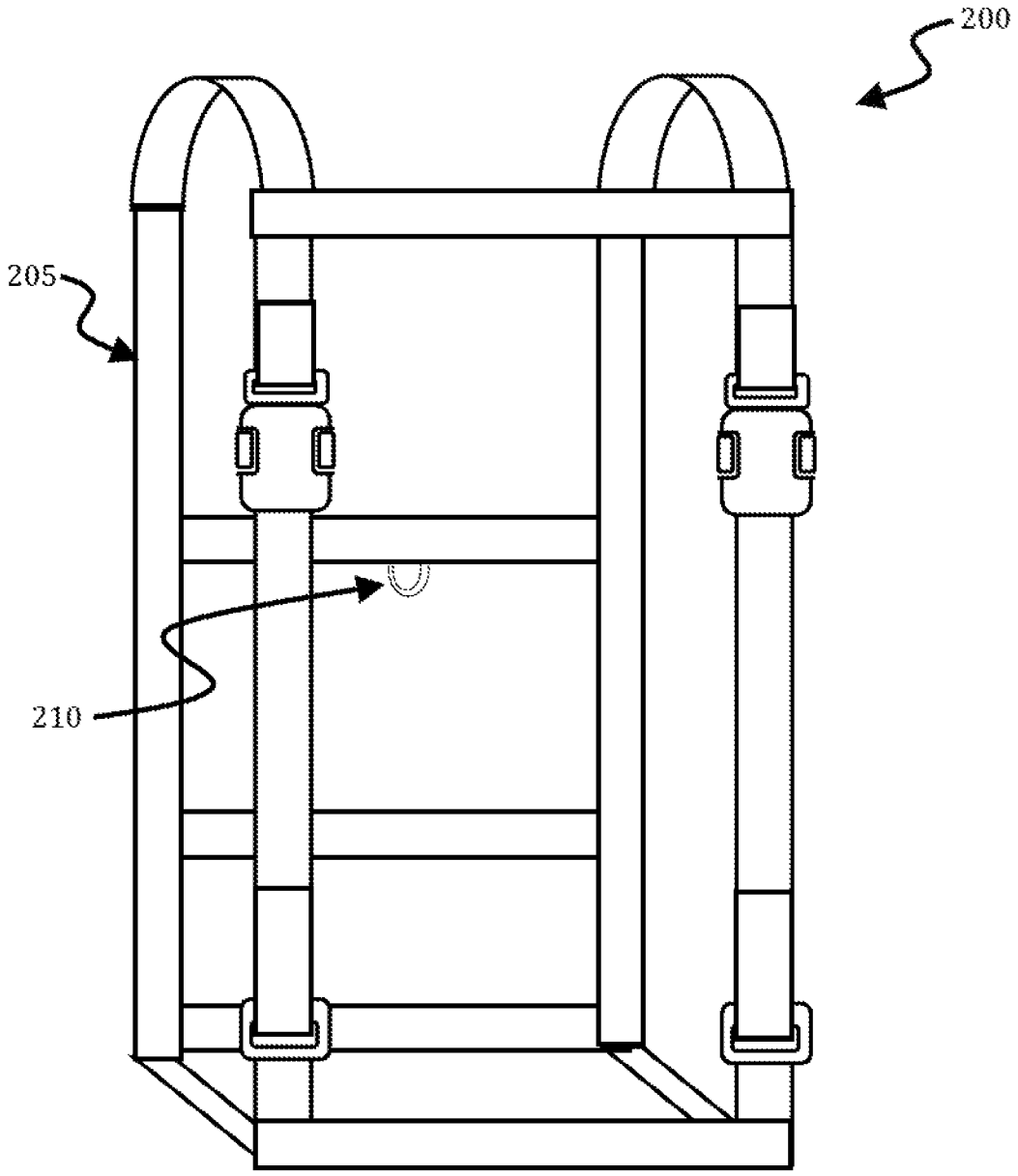
FIG. 2 depicts a convertible shoulder strap harness in accordance with the disclosed embodiments.

The right shoulder strap 125 and left shoulder strap 126 are configured to be attached and released from the attachment points 120-123 and further convert to a shoulder harness pulling system 200 as illustrated in FIG. 2. As shown in FIG. 2, the shoulder harness pulling system 200 incorporates the right shoulder strap 125 and left shoulder strap 126 with a system of straps 205. The system of straps includes an anchor and ring assembly 210 that can be connected to a rope, carabiner, or other such connecting device that connects the shoulder harness pulling system 200 to the tire 105.

At least two handles, right handle 130 and left handle 131 are attached to the tire and configured to accommodate human hands. The handles 130 and 131 can be connected to the tire at each of the handles 130 and 131 terminal ends.

In one embodiment, the two handles 130 and 131 (e.g., carrying straps) can be placed at the 3:00 o'clock and 9:00 o'clock positions on the tire 105, respectively. The handles 130 and 131 are provided to facilitate upper body and core exercises. The handles 130 and 131 can be nylon with plastic covering for comfort and durability. The handles 130 and 131 are durable and are configured to provide excellent grip during outdoor applications to ensure user safety. The handles 130 and 131 can be attached by drilling holes into the tire 105 using, for example, a 5/16 inch drill bit and secured using, for example, ¼ by ¾ inch machine screws. The handles 130 and 131 can be held in place with nuts and washers.

The handles 130 and 131 allow the user to perform a variety of exercises in a manner not previously offered. Thus, the system 100 provides a way to exercise a user's upper body, so called "core" muscle groups, abs, back, and upper legs.

At least two anchors, such as set anchor 135, and swivel anchor or D-ring anchor 140 can be attached to the tire 105. The set anchor 135 can comprise a rod and loop arrangement that is stiff and affixed to the outer, treaded surface of the tire 105. The D-ring anchor 140 is configured to have a loose loop that can be adjusted and can be affixed to the sidewall of the tire. It should be appreciated that one or more of both the set anchor 135 and the D-ring anchor 140 can be affixed to the tire in any number of locations according to design considerations.

Figure 4:
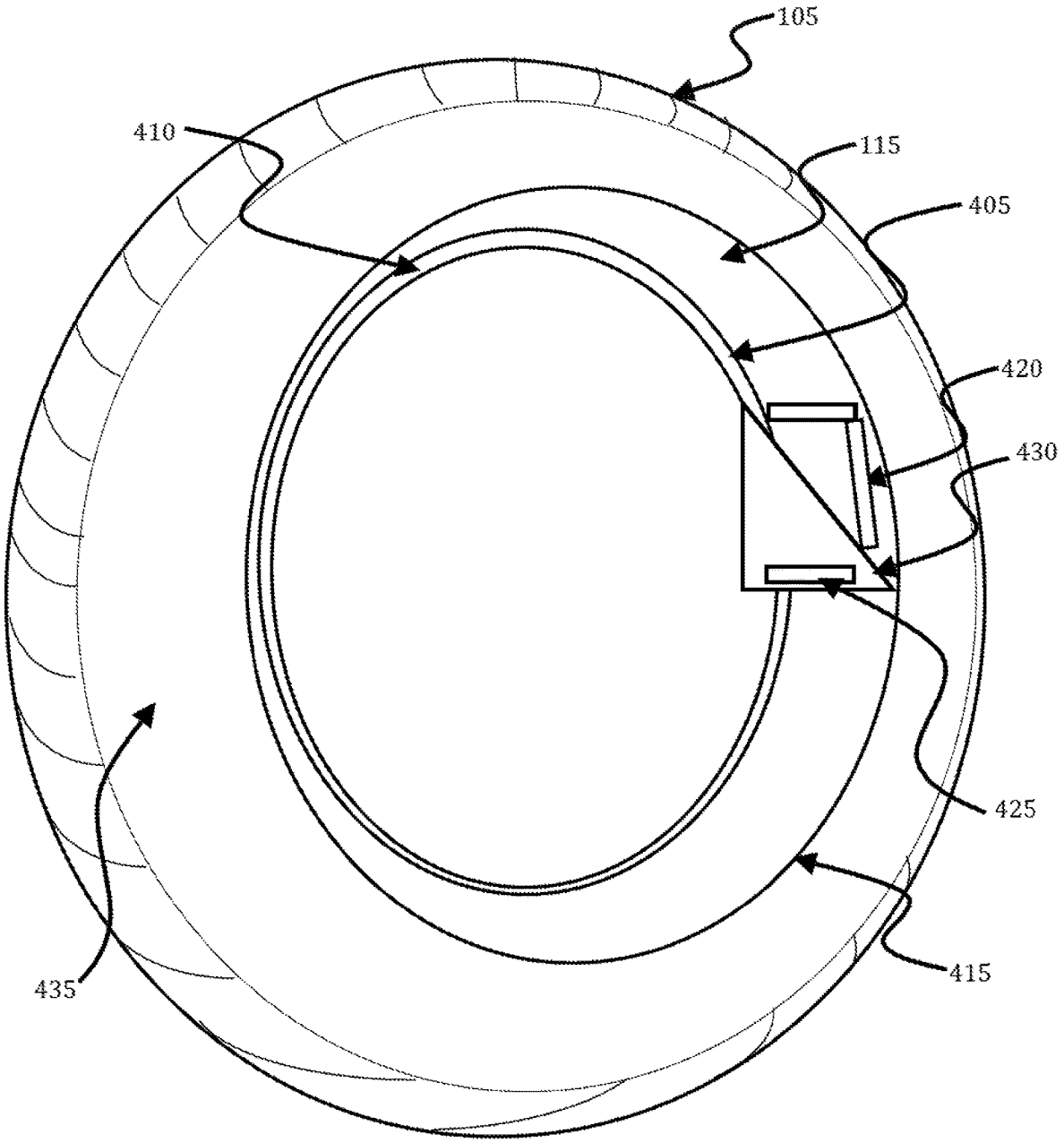
FIG. 4 depicts an inner tire cover system in accordance with the disclosed embodiments.

The inner tire can be sealed with the inner tire cover 115, which is illustrated in additional detail in FIG. 4. The inner tire cover 115 can be made of a water resistant material and held in place with glue 405 and hook and loop fasteners. In an embodiment, the undersurface 410 of the tire (i.e., the portion of the tire facing the ground when the system is being pulled) can be held in place with glue 405 or other such permanent connection. On the upper surface 415, the inner tire cover 115 is held in place with a hook and loop fastener 420 formed on the tire and hook and loop fastener 425 formed on the inner tire cover 115. The hook and loop fastener 420 is glued circumferentially around the inner lip of the tire 105 on the outside upper surface 415 and held in place with clamps until dry.

In another embodiment, foam padding that has both a sticky side and a non-sticky foam side can be used in constructing the cover. The foam padding can be installed around the upper and lower opening of the tire. The cover can be cut to size using a template with a loop on the bottom side. A stiff wire can be inserted through the lower portion of the cut template to ensure the cover maintains its shape. Multiple holes (e.g. 8 holes) can be drilled into the bottom portion of the tire. The cover can then be secured to the bottom portion of the tire using zip ties or other such fastening devices. For the top, a hook fastener (e.g. a 2-inch wide hook fastener) can be used to cut the cover to the proper length. The hook fastener can be sewn in the half with a loop facing each side leaving a loop at the top. A second stiff wire can be fed through that sewn loop, and then it can be affixed to the top of the tire using zip ties or other such connection means. The cover can further include one or more loop fasteners along the length of the top, and that can then be secured to the tire using the loop side of the hook and loop fastener. The hook and loop connection can provide access into the tire to put things inside the tire.

The inner tire cover 115 can be cut to length (length and width will vary depending on the size of the diameter and radius of the tire 105) and can have the hook fastener 425 sewn along the top edge and over a portion where the inner tire cover 115 overlaps itself. At the overlap 430, there will be a hook fastener on one side and loop fastener on the other to ensure it is secure.

The inner tire cover 115 creates a closed space 435 inside the tire. The closed space 435 can be used to hold additional weight, water bottles, clothes, and/or additional work out equipment. The electronics, batteries, and mounting for the safety light 150 can also be held in the closed space 435.

The inner tire cover can be quickly removed via the hook and loop fasteners providing easy access to the closed space 435 for the placement or retrieval of items therein. The inner tire cover 115 can be water resistant and as a result can keep transported items clean and dry.

A safety light 150 can be attached to the tire 105. In an embodiment, the safety light 150 can be a red light that can flash, blink, or otherwise strobe, and is attached to the back of the system 100 for nighttime safety. In one embodiment, the safety light 150 can be attached to one of the tire anchor points.

Figure 3:
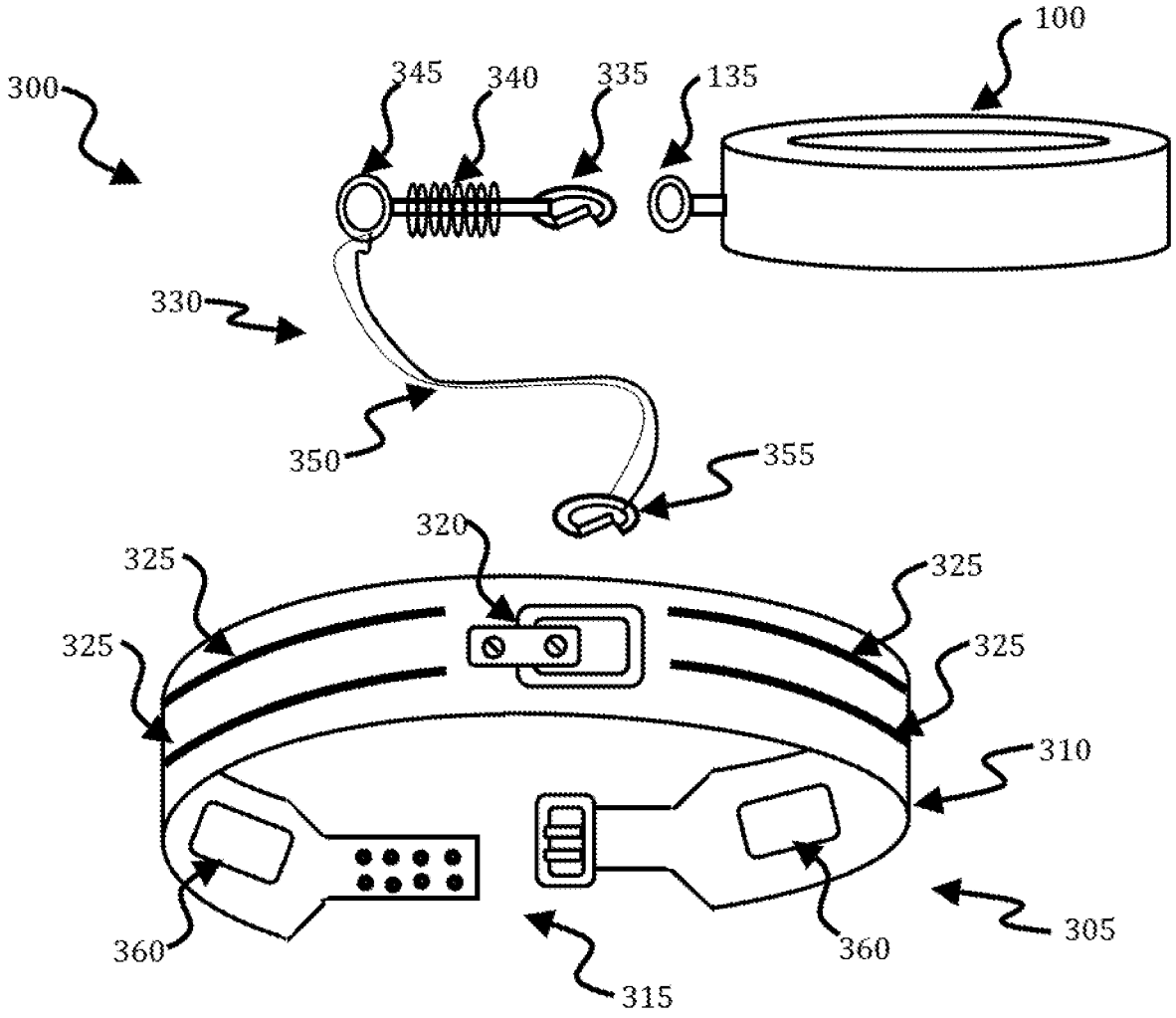
FIG. 3 depicts a tire pulling exercise system in accordance with the disclosed embodiments.

The set anchor 135 and D-ring anchor 140 can be configured to accommodate a rope, tire, and harness system 300 as illustrated in FIG. 3. It should be appreciated that the dimensional and material descriptions provided are exemplary, and in other embodiments, other dimensions and materials may be used.

As illustrated in FIG. 3, the rope, tire, and harness system 300 can include a waist harness 305 which further comprises a waist belt 310. The waist belt 310 can be connected with a fastening assembly 315 such as a hook and loop assembly or a male and female buckle assembly. The hook and loop fastener allows for easier donning and doffing of the waist belt 310.

The waist belt 310 can range in size from 2-5 inches in width and can be made of nylon, padded nylon, leather, or other such material. In some embodiments, the belt is designed as a fully padded 3-4 inch waist belt with a D-ring anchor 320 formed (e.g., sewn) into the substantially middle portion of the backside of the belt. The D-ring anchor 320 can be connected to the waist belt 310 in a manner that supports a minimum of 500 pound pulling force. The waist belt 310 is more efficient and easier on the user than a harness system for long pulls with the tire exercise system 100 attached. The padding 360 allows for more comfort.

Reflector strips 325 are attached to the waist belt. The reflector strips can comprise a reflective material such as reflective tape, reflective strips with hook and loop fastening means, etc. The four reflective tape strips 325 can be sewn into the right and left flank areas and on the right and left front sides of the belt. The reflector strips 325 are configured to be highly visible to improve the visibility of a user of the harness system 300 in low light, or otherwise dangerous conditions and acts as an added safety measure, helping to protect the runner during nighttime training. The contained waist harness 305 allows the user to attach and detach the rope system 330 quickly and efficiently.

The rope system 330 can be attached to the tire exercise system 100 and the waist harness 305. The rope system 330 can be attached to an anchor 320, in order to connect to the waist belt 310 and the tire system 100.

The rope system 330 includes a first carabiner 335 attached to a bungee cord 340, which can then be attached to the anchor 135 associated with the tire 105. A ring 345 can be attached to the bungee cord 340. A rope 350 can then be attached to the ring 345. A second carabiner 355 can be attached to the rope 350, which can then be attached to the waist harness 305 via connection with anchor 320 associated with the waist belt 310.

The entire harness system 300 can be configured to be safe to at least 500 pounds of pulling force. The rope 350 and bungee 340 can have reflective material configured in them for added safety during night training. The rope 350 and bungee cord 340 can have a pulling strength in excess of 500 pounds. Likewise, all of the metal attachments (e.g., anchor 320, carabiner 355, ring 345, carabiner 335, anchor 135, and anchor 140 can be rated at greater than 500 pounds).

Figure 5:
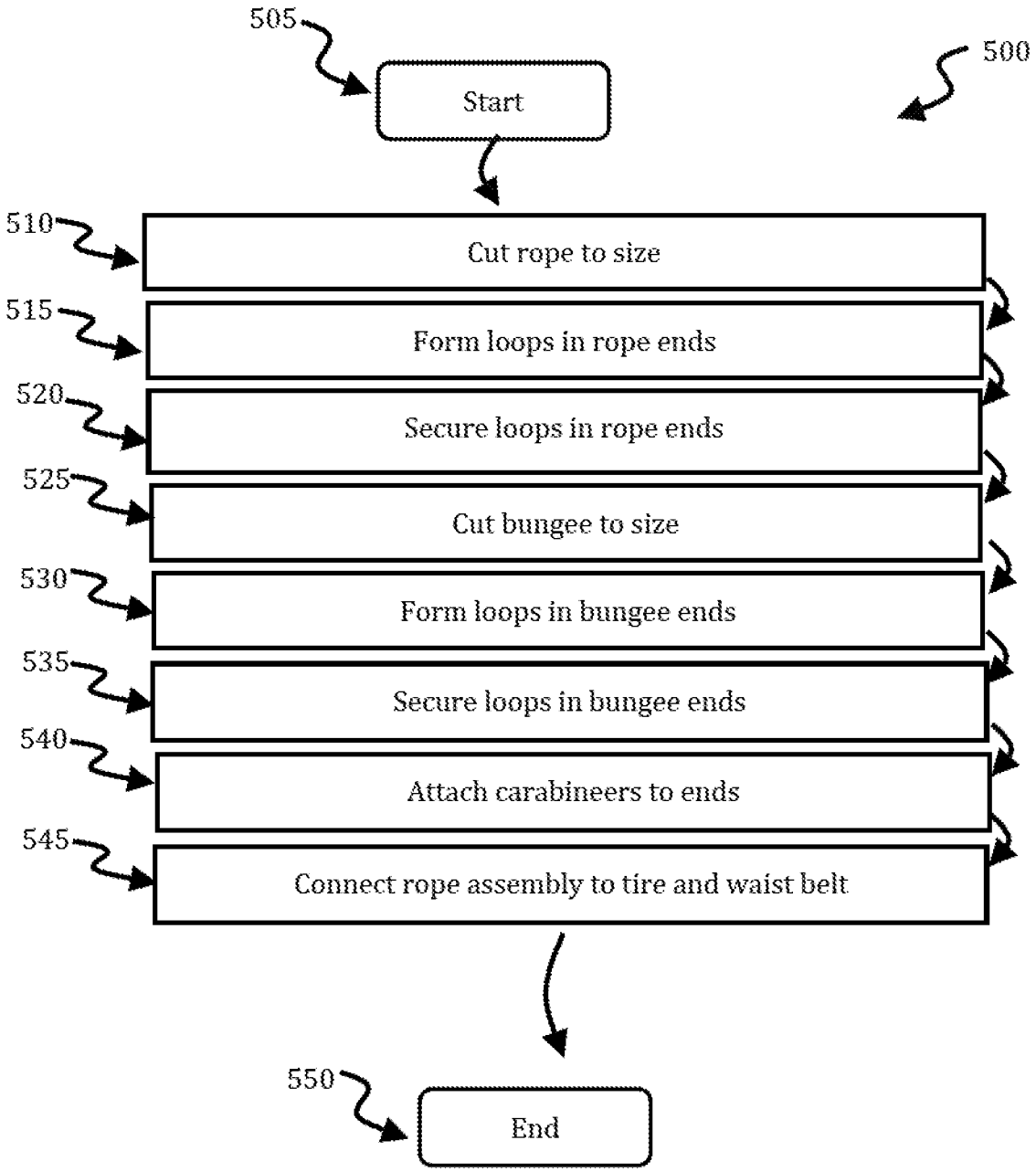
FIG. 5 depicts a flow chart illustrating steps of a method for fabricating a rope system in accordance with the disclosed embodiments.

An exemplary embodiment of a method 500 for assembling the system 300 is provided in FIG. 5. It should be appreciated that the dimensional and material descriptions provided are exemplary, and in other embodiments, other dimensions and materials may be used provided such dimensions and materials address specific shortcomings of the exemplary embodiment.

In an exemplary embodiment, a method for fabricating a system 300 can be begin at step 505. At step 510, the rope section can be created by cutting seven to nine foot lengths of ⅜ inch nylon rope 350. The rope 350 can be cut with a heated cutting tool to insure the ends do not fray.

Once the appropriate rope length is cut, loops with an internal diameter of approximately four inches can be made at each end, at step 515. The loops can be held in place by hog rings measuring 1 to 1¼ inch. On one end, a one inch round ring is secured in place in the loop. Once the loops are formed with the one inch round ring in place, they can be clamped down with the hog ring. Any excess rope can be cut with the heating tool, and the ends of the rope can be secured as shown at step 520, for example, with tape such as electrical tape, and sealed with a two inch heat wrap to protect the ends from damage during use.

With the rope side complete, a similar process can be employed to prepare the bungee side of the rope system 330. At step 525, the bungee 340 can be cut into 17-19 inch lengths with a heated cutting tool to insure the ends do not fray. Once the appropriate length of bungee 340 is cut, loops with an approximate internal diameter of three inches can be made at step 530, and then held in place by hog rings. On one end, a one inch round ring is secured in place in the loop, which is also attached to the bungee. Once the loops are made and the one inch round ring is in place, they are appropriately clamped down using the hog ring. The excess bungee can be cut with the heating tool and the ends can be secured, as shown at step 535, with tape, such as electrical tape, and sealed with two inch heat wrap to protect the ends from damage during use. Both sides of the rope system are now complete. In certain embodiments a rope core or other such cover can be used to cover the bungee. The covering protects the bungee from damage.

A carabiner 335 and a carabiner 355 (e.g., a 5/16 carabiner) can then be attached to the end of the bungee side and the rope side respectively as shown at step 540. The carabiners 335 and 355 allow the nylon rope to be hooked into the nylon or leather belt on one end and the tire on the other as shown at step 545. The system 300 is now ready for use and the method ends at step 550.

Figure 6:
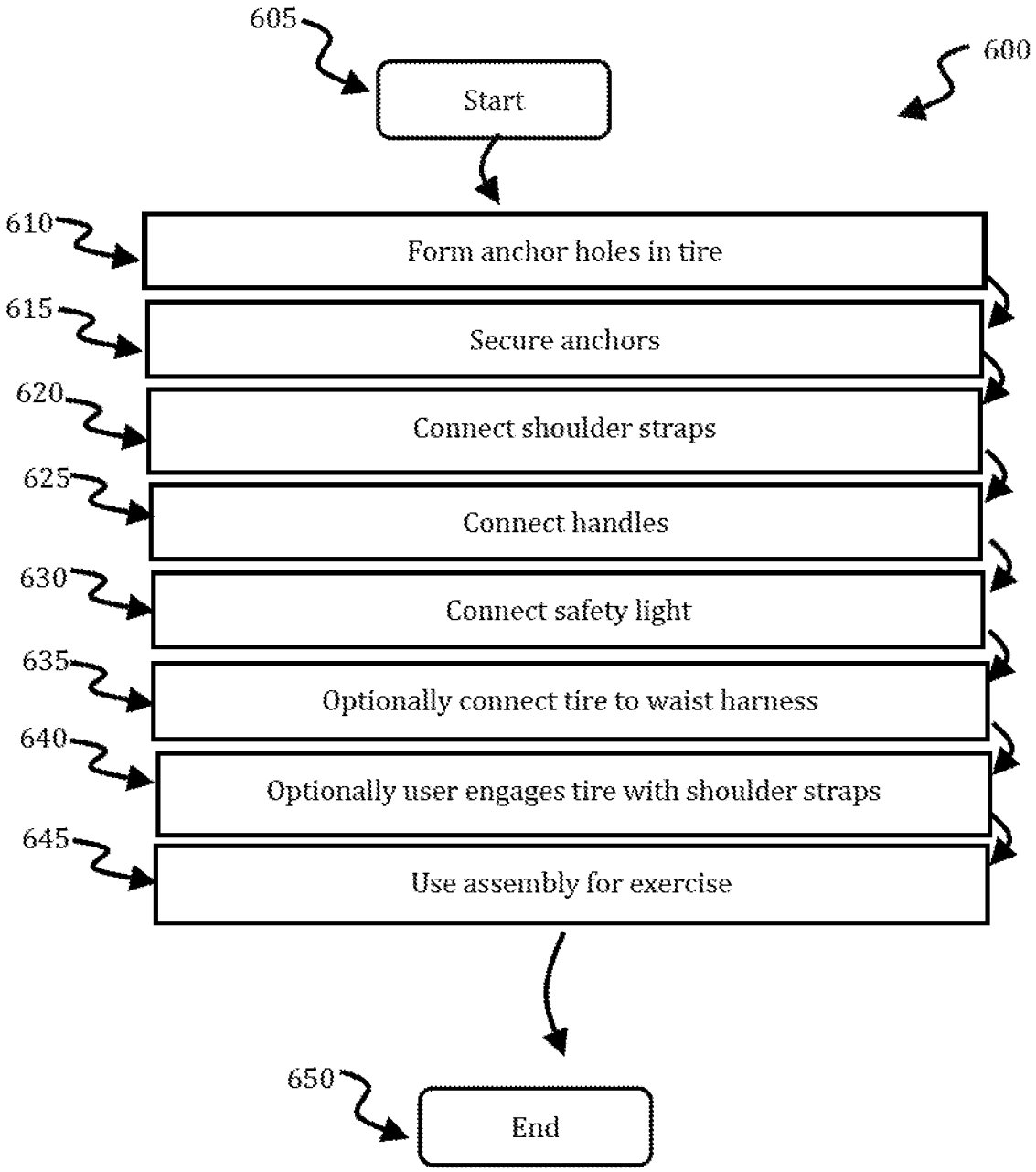
FIG. 6 depicts a flow chart illustrating steps of a method for fabricating a tire exercise system in accordance with the disclosed embodiments.

An exemplary embodiment of a method 600 for assembling the tire exercise system 100 is provided in FIG. 6. It should be appreciated that the dimensional and material descriptions provided are exemplary, and in other embodiments, other dimensions and materials may be used provided such dimensions and materials address specific shortcomings of the exemplary embodiment. The method begins at step 605.

The anchors can be installed the middle of the tire where screw holes can be drilled with a ⅜ inch steel drill bit or 5/16 inch router as shown at step 610. Once the holes are formed, the anchor is secured as shown at step 615 with 2¼×¾ inch machine screw and 1 each 1-1½ inch washers are placed inside the tire. It should be appreciated that, in this embodiment, there are two such anchors attached in the same manner at the 12:00 o'clock and 06:00 o'clock positions on the tire. One is for attaching the main rope system and the second is to hold a blinking red light for safety during night time use.

It should be understood that the anchors/anchoring system disclosed herein allow for the D-ring type anchors to lay flat when they are not in use. The screw and washer attachment allows for increased strength in the anchor, and consequently can handle additional pulling force.

The anchor system improves on traditionally used eyebolts, which are both inconvenient and less strong. The anchor system disclosed herein can be tightened in such a manner that it/they lay flat when the tire is being used for upper body weight training, when the system is being carried with the shoulder straps or handles, and/or during transportation of the system. This reduces injury risk and prevents the anchors from getting in the way when the system is not be used as a sled for pulling type exercises.

With the anchors secured, the shoulder straps can be connected to the tire at step 620 and the handles can be connected to the tire at step 625. A safety light can also be mounted to the tire system at step 630 in a hole in the tire prepared in the manner described at step 610.

With the tire system assembly complete, a user can optionally connect the tire system to the waist harness at step 635, and engage the tire with the shoulder straps at step 640. At step 645, the tire system can be used to facilitate any number of exercises, in accordance with the disclosed embodiments. The method ends at step 650.

In other embodiments, the anchors can be used to attach a second tire to the first tire system for additional drag/weight. In still other embodiments, another rope system can be attached to the tire, and the system can be used as a tug of war type exercise system or gaming apparatus.

Figure 7:
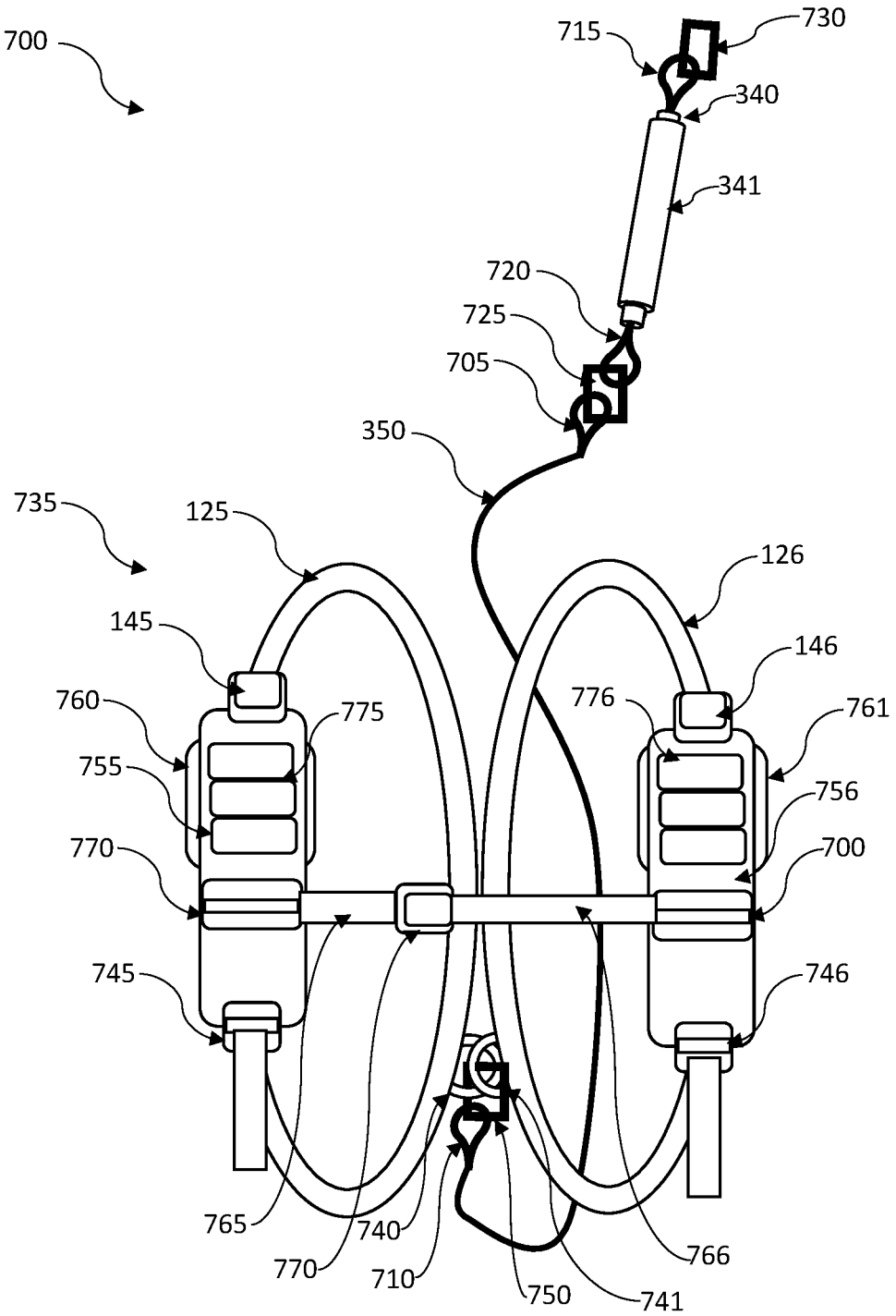
FIG. 7 depicts another embodiment of a pulling system in accordance the disclosed embodiments.

FIG. 7 illustrates another embodiment of a system 700 in accordance with the disclosed embodiments. The system 700 comprises a rope 350 connected to a bungee 340. The rope 350 can include an eyelet 705 threaded with the rope 350 on one end and an eyelet 710 threaded with the rope 350 on the other end.

The system 700 further includes a bungee 340 with an eyelet 715 on one end and an eyelet 720 on the other end. Either of eyelet 715 or eyelet 720 can be connected to a carabiner 725 that is also connected to either rope eyelet 705 or rope eyelet 710. The bungee 340 can be covered by a bungee cover 341. The bungee cover 341 can comprise a rope core, or other such tubing. In this way, the system 700 can form a section of rope 350 connected to a bungee 340 via carabiner 725.

A second carabiner 730 can be used to connect the free eyelet associated with the bungee 340 to an anchor, such as anchor 135, connected to a tire. The free eyelet associated with the rope 350 can then be connected to, for example, a set of shoulder straps associated with a removable shoulder strap system 735, a shoulder harness pulling system 200, a waist harness 305, or some combination thereof simultaneously.

In an embodiment, the rope 350 can be connected to removable shoulder strap system 735. It should be understood that the removable shoulder strap system 735 can comprise right shoulder strap 125 and left shoulder strap 126 removed from the tire 105. Shoulder strap 125 can be connected to itself via quick release bracket 145, and shoulder strap 126 can be connected to itself via quick release bracket 146. Thus, each of the shoulder straps 125 and 126 form a loop. A D-ring 740 can be provided on shoulder strap 125 and a D-ring 741 can be provided on shoulder strap 126. The length of the loop of shoulder strap 125 can be adjusted with a length adjusting clip 745, and length of the loop of shoulder strap 126 can be adjusted with a length adjusting clip 746. The straps can thus be adjusted to fit each of the user's shoulders.

Shoulder strap 125 can be fitted with a wider shoulder fitting 755. The reverse side of the wider shoulder fitting 755 can include a hook and loop connection to a shoulder pad 760. The hook and loop connection allows the user to adjust the location of the pad 760. The shoulder straps 125 can further include a chest strap 765 with a quick release connector 770. Likewise, shoulder strap 126 can be fitted with a wider shoulder fitting 756. The reverse side of the wider shoulder fitting 756 can include a hook and loop connection to a shoulder pad 761. The hook and loop connection allows the user to adjust the location of the pad 761. The shoulder strap 126 can further include a chest strap 766 with the other member of the quick release connector 770, such that the chest strap can be connected across the user's chest. Shoulder strap 125 and shoulder strap 126 can further include loops 775 and loops 776 respectively formed on the outer sides. The loops 775 and loops 776 provide connection points for additional devices if desired.

With the shoulder strap system 735 properly adjusted to the user, a carabiner 750 can be connected to the eyelet 710 of rope 350. The carabiner 750 can further be connected to each of D-rings 740 and 741. This configuration allows the user to pull a tire 105 or other such device with the shoulder strap system 735 providing additional emphasis on the upper core muscles.

In another embodiment, the rope 350 can be connected through the anchor 320 on the waist belt 310 and then to the D-ring 740 and D-ring 741 associated with the shoulder strap system 735. In such an embodiment, pulling force can be imparted on the tire 105, both through the shoulder strap system 735 and the waist belt 310, modifying the muscle groups engaged during exercise.

Figure 8:
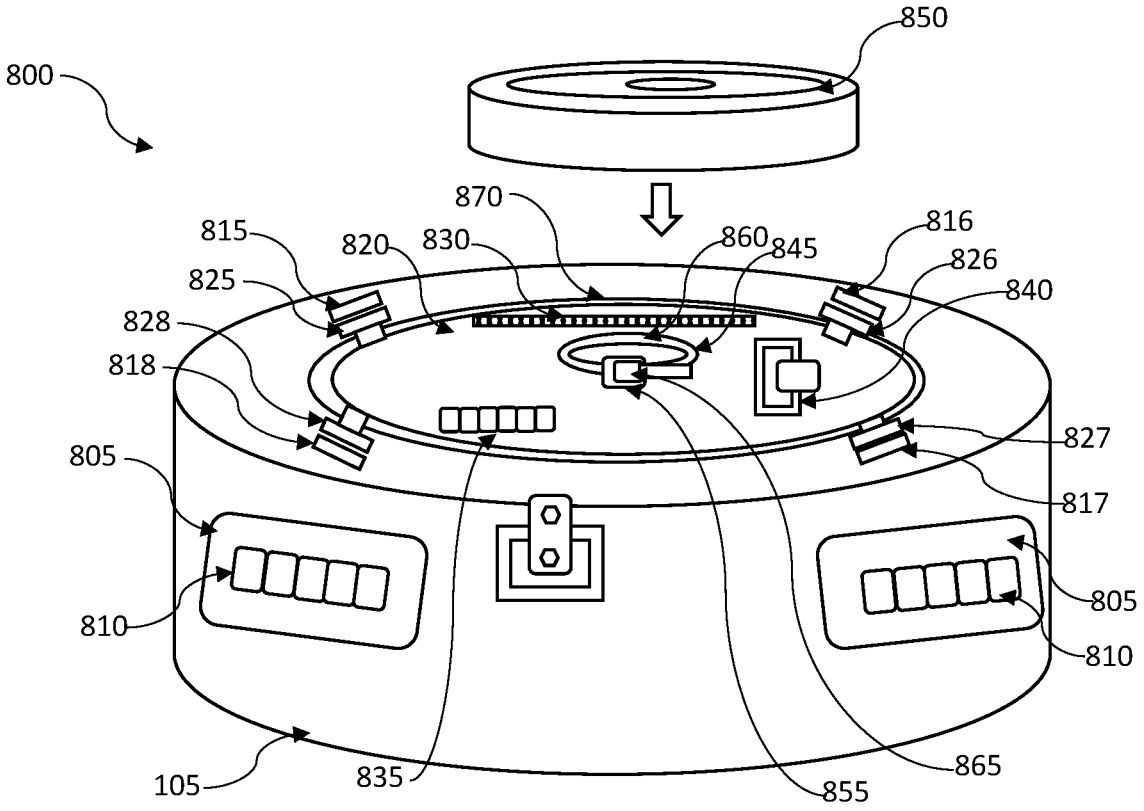
FIG. 8 depicts another embodiment of a tire pulling exercise system in accordance with the disclosed embodiments.

FIG. 8 illustrates additional features that can be incorporated into a tire exercise system 800. It should be understood that any of the features described in FIGS. 1-7 can be incorporated in, or with, the system 800. In this embodiment, the exterior of the tire 105 can be further configured with a hook and loop connection to a piece of material 805. The material can comprise, fabric and can be configured with one or more loops 810 which provide additional connection points for attaching external devices. In certain embodiments, additional section of material can be configured on the tire exterior according to design considerations.

The system 800 can further comprise a platform assembly 870 with four connection points 815-818. In certain embodiments, these connection points can be snaps, clips, or other such connection means. Each of the connection points 815-818 is configured to engage with a matching connection point 825-828 formed on a waterproof bag 820. In certain embodiments the connection points 825-828 can be connected to the bag 820 via straps, bungees, rope, ties, etc. The bag 820 can thus be connected to each of the four (or more) connection points on the tire 105, so that the bag 820 forms a platform covering, or partially covering, the center opening in the tire 105.

The bag 820 can include a weatherproof sealing mechanism 830 such as a weatherproof zipper or the like. The bag 820 can be used to hold personal belongings inside (e.g. a wallet, keys, sunglasses, etc.) so that they are protected from the elements while the system 800 is in use. In addition, a loop or a series of loops 835 can be provided on the upward facing or downward facing sides of the bag 820. A handle 840 can be provided on the exterior surface of the bag to ease handling.

As a user trains with the system 800 it may become desirable to add weight to the system 800. In certain embodiments a strap assembly 845 can be provided on the bag 820 that can be used to secure one or more weights 850 to the bag 820. The strap assembly 845 can comprise a strap 860 and a quick release connector 855 comprising a snap, clip, or the like connected to the bag 820. The strap 860 can be connected with the quick release connector 855 to form a loop. Weights 850 can be set on the bag 820 (preferably after the bag is connected in place on the tire 105). The strap 860 can be run through the center hole in the weights 850 and then snapped together with the quick release connector 855. The strap 860 can be equipped with a tensioning device 865 such as an additional loop on the quick release connector 855. The strap 860 can be pulled tight so that the weights 850 are secured to the platform formed by the bag 820.

The system and methods disclosed herein provide numerous advantages. For example, the system is a single contained unit that provides an ideal type of resistance and thus provides excellent training results. The connections between the rope, waist belt, and the bungee cord allow for maximum pull, adequate resistance, and reduced bounce during tire pulling, which is often problematic with prior art systems. The rings allow the rope and bungee to be attached in an efficient and effective manner eliminating the need to tie components together or in place. The carabiners allow for quick attachment and removal as needed. In addition, the components can be sized to accommodate over 1,000 pounds of force. The rope and bungee cord also allow for some stretch, are lightweight, and are easy to use, as compared to prior art approaches.

Persons of ordinary skill in the art of tire pulling may appreciate that numerous design configurations make it possible to enjoy the functional benefits of the system. Thus, given the wide variety of configurations and arrangements of embodiments of the present invention, the scope of the invention is reflected by the breadth of the claims below rather than narrowed by the embodiments described above.

Based on the foregoing, it can be appreciated that a number of embodiments, preferred and alternative, are disclosed herein. For example, in one embodiment, a tire exercise system comprises a tire having an interior portion covered with an inner tire cover, at least two shoulder straps attached to the tire, at least two handles attached to the tire, and at least one anchor attached to the tire.

In an embodiment, the system further comprises a rope system configured to attach to the tire via the at least one anchor. The rope system further comprises a first carabiner attached to a bungee cord and the at least one anchor on the tire, a ring attached to the bungee cord, a rope attached to the ring, and a second carabiner attached to the rope.

In an embodiment, the system further comprises a waist harness, the waist harness configured to attach to the tire via the rope system. The waist harness further comprises a waist belt, an anchor attached to the waist belt, and at least one reflector strip attached to the waist belt.

In an embodiment, at least four shoulder strap attachment members attached to the tire are configured to mount the two shoulder straps to the tire. The should straps further comprise a convertible shoulder harness pulling system. In an embodiment of the system, a safety light is attached to the tire.

In another embodiment, a tire exercise apparatus comprises a tire having an interior portion covered with an inner tire cover, at least two shoulder straps attached to the tire, at least two handles attached to the tire, and at least one anchor attached to the tire.

In an embodiment, the apparatus further comprises a rope system configured to attach to the tire via the at least one anchor. The rope system further comprises a first carabiner attached to a bungee cord and the at least one anchor on the tire, a ring attached to the bungee cord, a rope attached to the ring, and a second carabiner attached to the rope.

In an embodiment, the apparatus further comprises a waist harness, the waist harness configured to attach to the tire via the rope system. The waist harness further comprises a waist belt, an anchor attached to the waist belt, and at least one reflector strip attached to the waist belt.

In an embodiment, at least four shoulder strap attachment members attached to the tire are configured to mount the two shoulder straps to the tire. The should straps further comprise a convertible shoulder harness pulling system. In an embodiment of the system, a safety light is attached to the tire.

In yet another embodiment, an exercise system comprises a tire having an interior portion covered with an inner tire cover, at least two shoulder straps attached to the tire, at least two handles attached to the tire, at least one anchor attached to the tire, and at least one rope system, the rope system further comprising: a first carabiner attached to a bungee cord and the at least one anchor on the tire, a ring attached to the bungee cord, a rope attached to the ring, and a second carabiner attached to the rope.

In an embodiment, the system further comprises a waist harness, the waist harness further comprising a waist belt, an anchor attached to the waist belt, and at least one reflector strip attached to the waist belt, the waist harness configured to attach to the tire via the rope system.

In an embodiment, the system further comprises at least four shoulder strap attachment members attached to the tire and configured to mount the two shoulder straps to the tire wherein the should straps are configured to be converted to a shoulder harness pulling system that attaches to the tire via the rope system. In an embodiment, a safety light is attached to the tire.

In an embodiment a connection system comprises a bungee cord; at least one carabiner connected to the bungee cord and configured for connecting the bungee cord to an anchor; at least one eyelet attached to the bungee cord; and a rope attached to bungee cord. In an embodiment the system further comprises a bungee cord cover the cover configured to protect the bungee cord.

In an embodiment the connection system further comprises a waist harness, the waist harness configured to attach to the rope. In an embodiment the waist harness further comprises a waist belt, an anchor attached to the waist belt, and at least one reflector strip attached to the waist belt.

In an embodiment the system further comprises a shoulder strap system, the shoulder strap system configured to attach to the rope. In an embodiment the shoulder strap system further comprises: a first shoulder strap, a second shoulder strap, and a chest strap. In an embodiment the system further comprises a first D-ring connected to the first shoulder strap; and a second D-ring connected to the second shoulder strap. In an embodiment the system further comprises a carabiner connecting the first D-ring and the second D-ring to the rope.

In an embodiment the system further comprises a waist harness, the waist harness configured to attach to the rope, and a shoulder strap system, the shoulder strap system configured to attach to the rope.

In another embodiment a tire exercise system comprises a tire, at least two shoulder straps attached to the tire, at least two handles attached to the tire, at least one anchor attached to the tire, a rope system configured to attach to the tire via the at least one anchor, and a platform assembly attached to the tire. In an embodiment the tire exercise system further comprises at least four attachment members connected to the tire.

In an embodiment the platform assembly further comprises: a bag and at least four attachment members connected to the bag. In an embodiment the bag comprises a weatherproof bag.

In an embodiment the tire exercise system further comprises a strap connected to the bag. In an embodiment, the tire exercise system further comprises at least one weight, wherein the strap is configured to secure the at least one weight to the bag.

In an embodiment the rope system further comprises: a bungee cord, at least one carabiner connected to the bungee cord and configured for connecting the bungee cord to an anchor, at least one eyelet attached to the bungee cord, and a rope attached to bungee cord. In an embodiment, the tire exercise system comprises a bungee cord cover the cover configured to protect the bungee cord.

In an embodiment an exercise system comprises at least two shoulder straps configured to attach to a tire, at least two handles configured to attach to a tire, at least one anchor configured to attach to a tire, a rope system configured to attach to a tire via the at least one anchor, and a platform assembly configured to attached to a tire.

In an embodiment the platform assembly further comprises: a bag, at least four attachment members connected to the bag.

In another embodiment the system comprises a strap connected to the bag; and at least one weight, wherein the strap is configured to secure the at least one weight to the bag.

It will be appreciated that variations of the above-disclosed and other features and functions, or alternatives thereof, may be desirably combined into many other different systems or applications. Also, it will be appreciated that various presently unforeseen or unanticipated alternatives, modifications, variations or improvements therein may be subsequently made by those skilled in the art which are also intended to be encompassed by the following claims.

What is claimed is:

1. A connection system comprising:
- a bungee cord;
- a first bungee eyelet at an end of the bungee cord;
- a first carabiner connected to said first bungee cord eyelet and configured for connecting said bungee cord to an anchor associated with exercise equipment;
- a second bungee eyelet;
- a rope comprising a first rope eyelet and a second rope eyelet, wherein the first rope eyelet attaches to said second bungee eyelet; and
- a waist harness, said waist harness configured to attach to said second rope eyelet.

2. The connection system of claim 1 further comprising:
- a bungee cord cover configured to protect said bungee cord.

3. The connection system of claim 1 wherein said waist harness further comprises:
- a waist belt;
- an anchor attached to said waist belt;
- at least one pad formed in the belt; and
- at least one reflector strip attached to said waist belt.

4. The connection system of claim 1 further comprising:
- a shoulder strap system, said shoulder strap system configured to attach to said rope.

5. The connection system of claim 4 wherein said shoulder strap system further comprises:
- a first shoulder strap;
- a second shoulder strap;
- a chest strap; and
- at least one quick release bracket configured to connect the shoulder strap system to a tire so that the tire can be carried.

6. The connection system of claim 5 further comprising:
a first D-ring connected to said first shoulder strap; and
a second D-ring connected to said second shoulder strap.

7. The connection system of claim 6 further comprising:
one carabiner connecting said first D-ring and said second D-ring to said second rope eyelet.

8. A connection system comprising:
a bungee cord;
a first bungee eyelet at an end of the bungee cord;
a first carabiner connected to said first bungee cord eyelet and configured for connecting said bungee cord to an anchor associated with exercise equipment;
a second bungee eyelet;
a rope comprising a first rope eyelet and a second rope eyelet, wherein the first rope eyelet attaches to said second bungee eyelet; and
a shoulder strap system, said shoulder strap system configured to attach to said rope.

9. The connection system of claim 8 wherein said shoulder strap system further comprises:
a first shoulder strap;
a second shoulder strap;
a chest strap; and
at least one quick release bracket configured to connect the shoulder strap system to a tire so that the tire can be carried.

10. The connection system of claim 9 further comprising:
a first D-ring connected to said first shoulder strap; and
a second D-ring connected to said second shoulder strap.

11. The connection system of claim 10 further comprising:
one carabiner connecting said first D-ring and said second D-ring to said second rope eyelet.

* * * * *